US010745903B1

(12) United States Patent
Houston et al.

(10) Patent No.: US 10,745,903 B1
(45) Date of Patent: Aug. 18, 2020

(54) BUILDING INCLUDING HORIZONTALLY-ORIENTED REINFORCED TRANSFER BEAMS AND A FABRICATION METHOD THEREFOR

(71) Applicant: BIG TIME INVESTMENT, LLC, Southfield, MI (US)

(72) Inventors: Stephen T. Houston, Lake Orion, MI (US); Brian K. Threet, Plymouth, MI (US)

(73) Assignee: BIG TIME INVESTMENT, LLC, Southfield, MI (US)

( * ) Notice: Subject to any disclaimer, the term of this patent is extended or adjusted under 35 U.S.C. 154(b) by 0 days.

(21) Appl. No.: 16/422,386

(22) Filed: May 24, 2019

(51) Int. Cl.
*E04B 1/24* (2006.01)
*E04B 1/58* (2006.01)
*E04C 3/04* (2006.01)

(52) U.S. Cl.
CPC ..... *E04B 1/2403* (2013.01); *E04B 1/5806* (2013.01); *E04B 1/5825* (2013.01); *E04C 2003/0408* (2013.01); *E04C 2003/0443* (2013.01)

(58) Field of Classification Search
CPC .... E04B 1/5812; E04B 1/5806; E04B 1/5825; E04B 1/5831; E04B 1/2403; E04C 2003/0452; E04C 2003/046; E04C 2003/0443; E04C 2003/0465; E04C 2003/0408
See application file for complete search history.

(56) References Cited

U.S. PATENT DOCUMENTS

| | | | | |
|---|---|---|---|---|
| 3,283,465 | A | 11/1966 | Cheskin | |
| 4,071,988 | A | 2/1978 | Bowes | |
| 7,634,891 | B2 * | 12/2009 | Fanucci | E04C 3/29 52/834 |
| 8,329,272 | B2 * | 12/2012 | Cesternino | B32B 1/00 428/35.7 |
| 8,905,718 | B2 * | 12/2014 | Hayden | B29C 70/865 416/224 |
| 2007/0256382 | A1 * | 11/2007 | Drolet | B29C 70/06 52/439 |
| 2016/0097199 | A1 * | 4/2016 | Saiidi | E01D 19/02 52/126.7 |

* cited by examiner

*Primary Examiner* — Andrew J Triggs
(74) *Attorney, Agent, or Firm* — Quinn IP Law

(57) ABSTRACT

A building that includes a lower structural pad disposed on a foundation is described, and includes columns disposed on the lower structural pad, including a first of the columns being separated from a second of the columns by a first span. The building includes a plurality of horizontally-oriented reinforced transfer beams, wherein each of the reinforced transfer beams spans between the first of the columns and the second of the columns. The building includes a vertical support core including a first vertically-oriented structural spine and a second vertically-oriented structural spine that are disposed on the reinforced transfer beams and separated by a second span. The second span associated with the first and second vertically-oriented structural spine is less than the first span associated with the first and second of the columns. Each of the reinforced transfer beams includes a steel beam and a carbon-fiber reinforcement element.

20 Claims, 4 Drawing Sheets

BUILDING INCLUDING HORIZONTALLY-ORIENTED REINFORCED TRANSFER BEAMS AND A FABRICATION METHOD THEREFOR

TECHNICAL FIELD

The disclosure generally relates to a building that is fabricated with horizontally-oriented reinforced transfer beams, and method for constructing such a building that includes a vertical slip form construction system.

BACKGROUND

Many methods of constructing multi-story buildings exist. Traditionally, multi-story buildings have been constructed from the ground up, in which construction of the building begins on a ground level by attaching higher elevation structural elements on top of previously assembled lower structural elements to construct the building in upward direction, i.e., from bottom up. This construction method requires that the structural elements be lifted by a crane and connected in situ at elevation. This is particularly time-consuming and costly when constructing tall buildings.

Known methods for constructing high-rise commercial buildings may be inefficient. Presently, structural framing elements may be assembled into a building frame one member at a time, well above ground level. Tower cranes may be used to facilitate construction, which may include executing thousands of individual lifts for each element of the structure, building enclosure, finishes, mechanical and electrical equipment and many other components of a finished building.

One known construction technique includes locating columns and other load-bearing elements directly beneath each other, extending vertically downward through the structure of a multi-story building. Transfer beams are horizontal beams that may be used where necessary to eliminate one or more inconveniently placed vertical load-bearing elements on a given floor level or levels. This is done to open an area to better accommodate a function, expand an underground parking structure, create a floor opening for an atrium, or for a similar purpose. Transfer beams fabricated from steel alone have a vertical depth that is designed to carry the load of the building. The vertical depth of steel transfer beams may interfere with the space below the beam, thus limiting its utility or creating a need to increase vertical height of a building and/or increase vertical depth of the subsurface portion of a building to achieve a desired function such as parking in certain circumstances and configurations.

SUMMARY

A building is described, and includes a lower structural pad that is disposed on a foundation. A plurality of columns are disposed on the lower structural pad, including a first of the columns that is separated from a second of the columns by a first span. The building includes a plurality of horizontally-oriented reinforced transfer beams, wherein each of the reinforced transfer beams spans between the first of the columns and the second of the columns. The building includes a vertical support core including a first vertically-oriented structural spine and a second vertically-oriented structural spine, wherein the first and second vertically-oriented structural spines are disposed on the reinforced transfer beams and separated by a second span. The second span associated with the first and second vertically-oriented structural spine is less than the first span associated with the first and second of the columns. Each of the reinforced transfer beams includes a steel beam and a carbon-fiber reinforcement element.

An aspect of the disclosure includes the carbon-fiber reinforcement element spanning a portion of the steel beam that is defined by the first span between the first and second columns.

Another aspect of the disclosure includes each of the transfer beams being one of an I-beam, a C-beam, a T-beam, an L-beam, a square beam, and a rectangular beam.

Another aspect of the disclosure includes each of the transfer beams including a flange portion disposed on at least one end thereof Another aspect of the disclosure includes each of the transfer beams including a plurality of pre-drilled holes.

Another aspect of the disclosure includes a floor plate suspended from the vertical support core, wherein the floor plate includes a floor plate frame that includes first and second girders and a plurality of framing members, and wherein each of the framing members being a reinforced beam that includes a steel beam and a carbon-fiber reinforcement element.

Another aspect of the disclosure includes each of the framing members including a medial beam that is attached to first and second cantilevered beams, and wherein each of the first and second cantilevered beams includes a reinforced beam including a steel beam and a carbon-fiber reinforcement element.

Another aspect of the disclosure includes each of the steel beams of the first and second cantilevered beams of the framing members being one of an I-beam, a C-beam, a T-beam, an L-beam, a square beam, or a rectangular beam.

Another aspect of the disclosure includes each of the first and second girders being a reinforced beam that includes a steel beam and a carbon-fiber reinforcement element.

Another aspect of the disclosure includes each of steel beams of the first and second girders being one of an I-beam, a C-beam, a T-beam, an L-beam, a square beam, or a rectangular beam.

The above features and advantages and other features and advantages of the present teachings are readily apparent from the following detailed description of the best modes for carrying out the teachings when taken in connection with the accompanying drawings.

It should be understood that the appended drawings are not necessarily to scale, and present a somewhat simplified representation of various preferred features of the present disclosure as disclosed herein, including, for example, specific dimensions, orientations, locations, and shapes. Details associated with such features will be determined in part by the particular intended application and use environment.

DETAILED DESCRIPTION

The components of the disclosed embodiments, as described and illustrated herein, may be arranged and designed in a variety of different configurations. Thus, the following detailed description is not intended to limit the scope of the disclosure, as claimed, but is merely representative of possible embodiments thereof. In addition, while numerous specific details are set forth in the following description in order to provide a thorough understanding of the embodiments disclosed herein, some embodiments can be practiced without some of these details. Moreover, for the purpose of clarity, certain technical material that is understood in the related art has not been described in detail in order to avoid unnecessarily obscuring the disclosure. Furthermore, the drawings are in simplified form and are not to precise scale. For purposes of convenience and clarity only, directional terms such as top, bottom, left, right, up, over, above, below, beneath, rear, and front, may be used with respect to the drawings. These and similar directional terms are not to be construed to limit the scope of the disclosure. Furthermore, the disclosure, as illustrated and described herein, may be practiced in the absence of an element that is not specifically disclosed herein. Those having ordinary skill in the art will recognize that terms such as "above," "below," "upward," "downward," "top," "bottom," etc., are used descriptively for the figures, and do not represent limitations on the scope of the disclosure, as defined by the appended claims.

Figure 1:
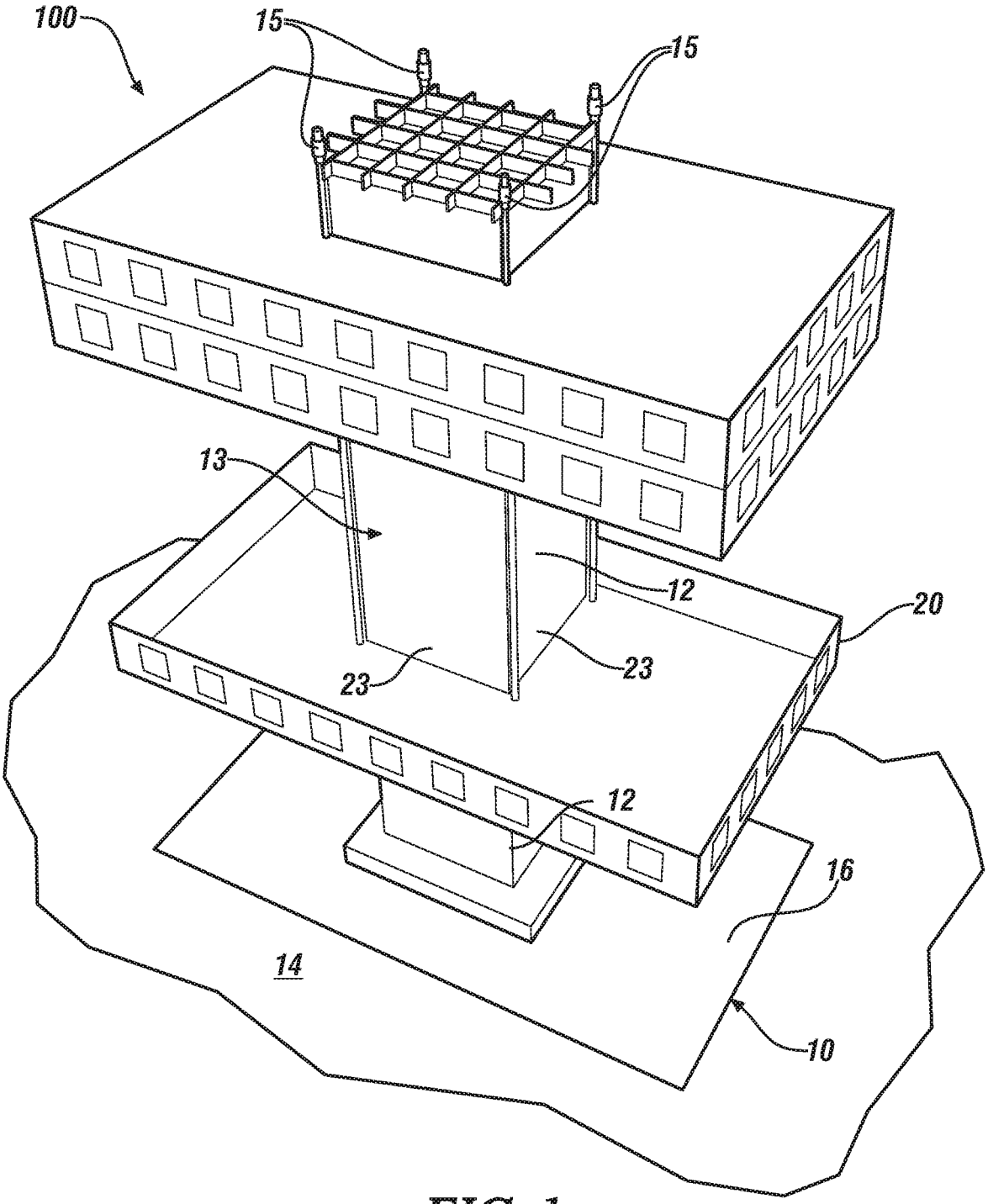
FIG. 1 is a schematic perspective view of a partially constructed building, in accordance with the disclosure.

Referring to the Figures, wherein like numerals indicate like parts throughout the several views, a construction system is generally shown at 10 in FIG. 1. The construction system 10 may be used to construct a building 100, and particularly a multi-story building 100. In general, the construction system 10 may be used to implement a top-down construction process, in which floor plates 20 are constructed at ground level 14, lifted to a respective final elevation, and attached to a vertical support core 12 of the building 100 in a descending, sequential order. The building 100 includes the vertical support core 12, which is assembled onto a foundation 11, and a plurality of the floor plates 20.

As used herein, the term " floor plate 20" may include all structural or frame members, e.g., joists and/or purlins, flooring, e.g., concrete floor, interior walls, exterior curtain walls, modular room subassemblies, e.g., a lavatory module, utilities, etc., that form a floor or level of the building 100. The term "floor plate 20" may include a plate for the roof structure of the building 100, as well as a plate for a floor or level of the building 100. Accordingly, it should be appreciated that the term "floor plate 20" is used herein to refer to both the roof structure for the roof of the building 100, as well as a floor structure for a floor or level of the building 100. As used herein and shown in the Figures, the reference numeral 20 may refer to and indicate any floor plate 20 of the building 100. The floor plate 20 specifically includes a floor plate frame 21, the fabrication of which is described herein.

The construction system 10 includes the vertical support core 12, which is an element of a vertical slip form system 13. The vertical slip form system 13 is operable to form the vertical support core 12 of the building 100 from a hardenable material while moving vertically upward from the ground level 14 to a finished elevation. The hardenable material may include, but is not limited to, a concrete mixture or other similar composition. The hardenable material may include one or more additives to enhance one or more physical characteristics of the hardenable material, such as to reduce curing time, reduce slump, increase strength, etc. The specific type and contents of the hardenable material may be dependent upon the specific application of the building 100, and may be dependent upon the specific geographic region in which the building 100 is being constructed. The specific type and contents of the hardenable material are understood by those skilled in the art, are not pertinent to the teachings of this disclosure, and are therefore not described in greater detail herein.

The vertical support core 12 is designed to carry the vertical loads the building 100. As such, the shape of the vertical support core 12 may be designed as necessary to provide the required compressive strength, shear strength, and bending strength for the particular application, size, and location of the building 100. It should be appreciated that the wall of the vertical support core 12 may be configured to include multiple load-bearing columns 24 connected by shear walls. In other embodiments, the wall of the vertical support core 12 may be designed to include a generally uniform construction around the entire perimeter of the vertical support core 12.

As shown in FIG. 1, the construction system 10 may further include a plurality of lifting device(s) 15 attached to the roof structure, which may be used for raising the roof structure and the floor plates 20 relative to the vertical support core 12. For example, the lifting devices 15 may include, but are not limited to a plurality of strand jacks, or other devices capable of lifting each of the floor plates 20 of the building 100. The specific features and operation of the lifting devices 15 are known to those skilled in the art, are not pertinent to the teachings of this disclosure, and are therefore not described herein. The roof structure and each of the floor plates 20 may be assembled at or near ground level 14 and lifted into their respective final elevations relative to the vertical support core 12 in a sequential descending order employing the lifting devices 15.

The floor plates 20 make up discrete sections of the building 100. Each of the floor plates 20 is assembled a few feet above ground level and lifted to its design elevation employing one or more of the lifting devices 15 or other vertical conveyance structure(s), and permanently affixed to and supported by the vertical support core 12. The floor plates 20 are cantilevered from the lifting devices 15 and therefore, the weight of each of the floor plates 20 is best distributed symmetrically around the vertical support core 12 and the lifting devices 15. The floor plates 20 may be designed asymmetrically around the lifting devices 15 so long as proper design and loading techniques are utilized.

Figure 2:
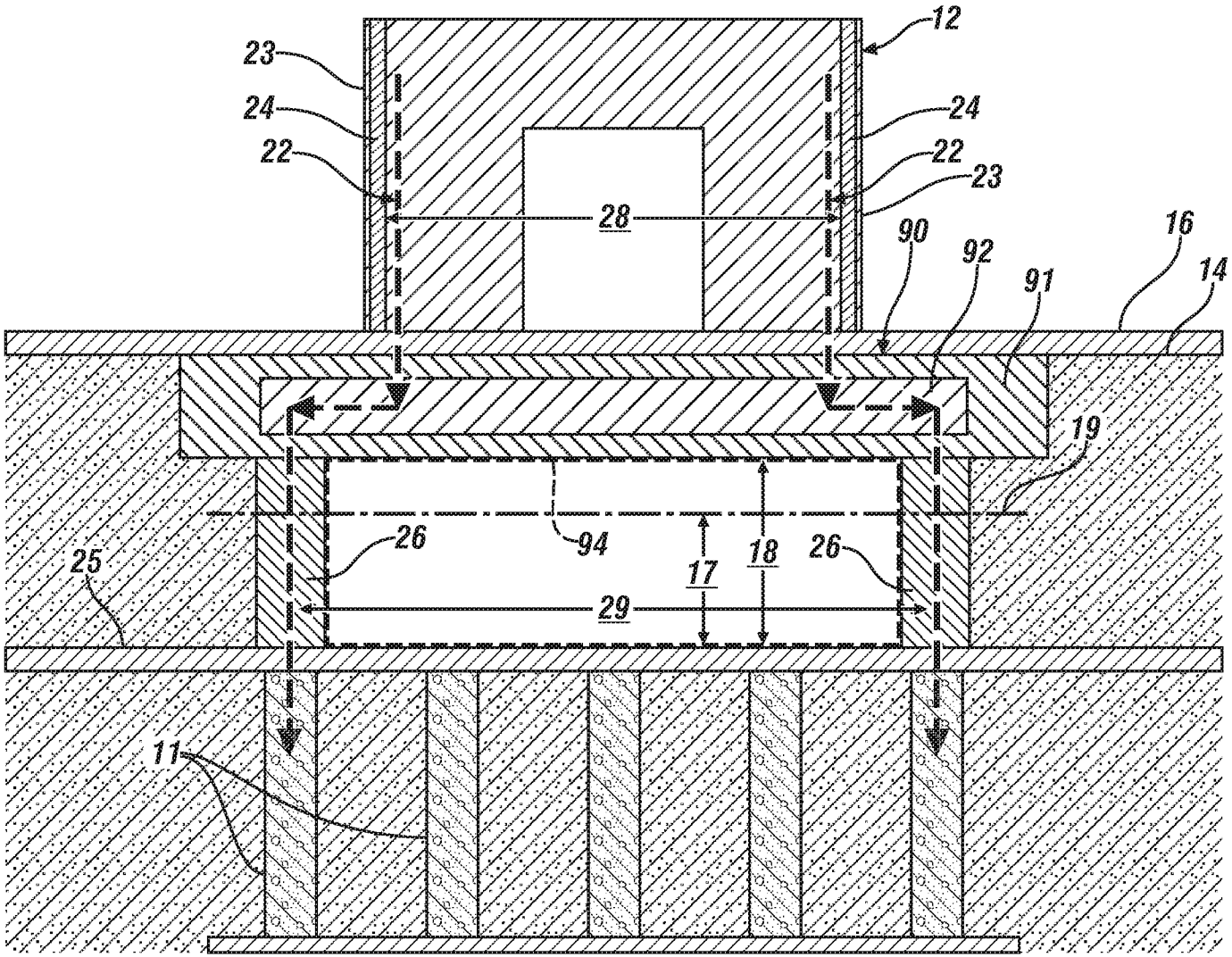
FIG. 2 is a schematic side view of a partially constructed building, including a vertical support core supported on an assembly pad that is supported by a transfer beam disposed on columns that are supported by a sub-surface foundation, in accordance with the disclosure.

FIG. 2 is a schematic side view of a partially constructed embodiment of the building 100 that is described with reference to FIG. 1, including the vertical support core 12 being supported on an assembly pad 16 that is supported by a reinforced transfer beam 90 that is disposed on a plurality of load-bearing columns 26 that are supported by a subsurface foundation 11. The assembly pad 16 is disposed at ground level 14, and all or a portion of the load-bearing columns 26 and the reinforced transfer beam 90 are disposed below the ground level 14 in one embodiment. The subsurface foundation 11 is disposed on a load-bearing substrate, e.g., bedrock. The building 100 is shown in a side view with elevation dimension indicated in the vertical direction and a lateral dimension indicated in the horizontal direction, and with a single reinforced transfer beam 90 disposed on a pair of load-bearing columns 26. It is appreciated that the building 100 is three-dimensional, and projects longitudinally, and thus includes multiple reinforced transfer beams 90 disposed on pairs of load-bearing columns 26 to support the assembly pad 16 and vertical support core 12, which are also three-dimensional elements. For purposes of simplified description, a single reinforced transfer beam 90 disposed on a pair of load-bearing columns 26 is described.

The reinforced transfer beam 90 is arranged in a simple span condition, supported at both ends by the vertically-oriented load-bearing columns 26 to carry and support a highly concentrated load from floors above, including structural spines 23 of the vertical support core 12. The load-bearing columns 26 disposed on a lower structural pad 25. As shown, a first of the load-bearing columns 26 is separated from a second of the load-bearing columns 26 by a first span 29. The structural spines 23 of the vertical support core 12 are disposed on one of the reinforced transfer beams 90 and separated by a second span 28. In one embodiment, the vertical support core 12 is centered on the reinforced transfer beams 90. As shown, and as described herein the second span 28 associated with the vertically-oriented structural spines 23 is less than the first span 29 associated with the first and second of the load-bearing columns 26. A load path 22 is indicated, which indicates that load is transferred to the reinforced transfer beam 90 below the building floor level that is defined by the assembly pad 16, which serves to offset the load path 22 to the load-bearing columns 26 disposed proximal to the ends of the reinforced transfer beam 90 and then to the foundation 11 that are bearing on earth or rock substrate. A three-dimensional open space 94 is indicated immediately below the structural spines 23, which is freed for use as an occupied space. Line 19 indicates a projected depth of a non-reinforced transfer beam (not shown) below the ground level 14. Dimension 17 indicates a vertical height of open space between the non-reinforced transfer beam (not shown) and the lower pad 25, and dimension 18 indicates a vertical height of the open space 94 between the lower level of the reinforced transfer beam 90 and the lower pad 25. This indicates that the use of the reinforced transfer beam 90 allows for an increase in the usable height of the open space 94 beyond what would be available using a non-reinforced steel beam.

The reinforced transfer beam 90 is configured as a structural steel beam 91 and a carbon-fiber reinforcement element 92. In one embodiment, only a portion of the length of the structural steel beam 91 includes the carbon-fiber reinforcement element 92. In one embodiment, the portion of the structural steel beam 91 that includes the carbon-fiber reinforcement element 92 is defined by the portion of the structural steel beam 91 that is supported by the load-bearing columns 26, as shown in FIG. 2.

Each of the structural steel beams 91 may be configured, by way of non-limiting examples as an I-beam, a C-beam, a T-beam, an L-beam, a square beam, a rectangular beam, etc. The carbon-fiber reinforcement element 92 may be fabricated from carbon-fiber reinforced polymer (CFRP) materials. In one embodiment, CFRPs are composite materials which employ carbon fibers and thermoset polymers to form a cohesive formable matrix that provides strength and stiffness that can be a shaped article. CRFP elements can be tailored to the application through varying strength, length, directionality and amount of the reinforcing fibers and in the selection of the polymer matrix.

Figure 4:
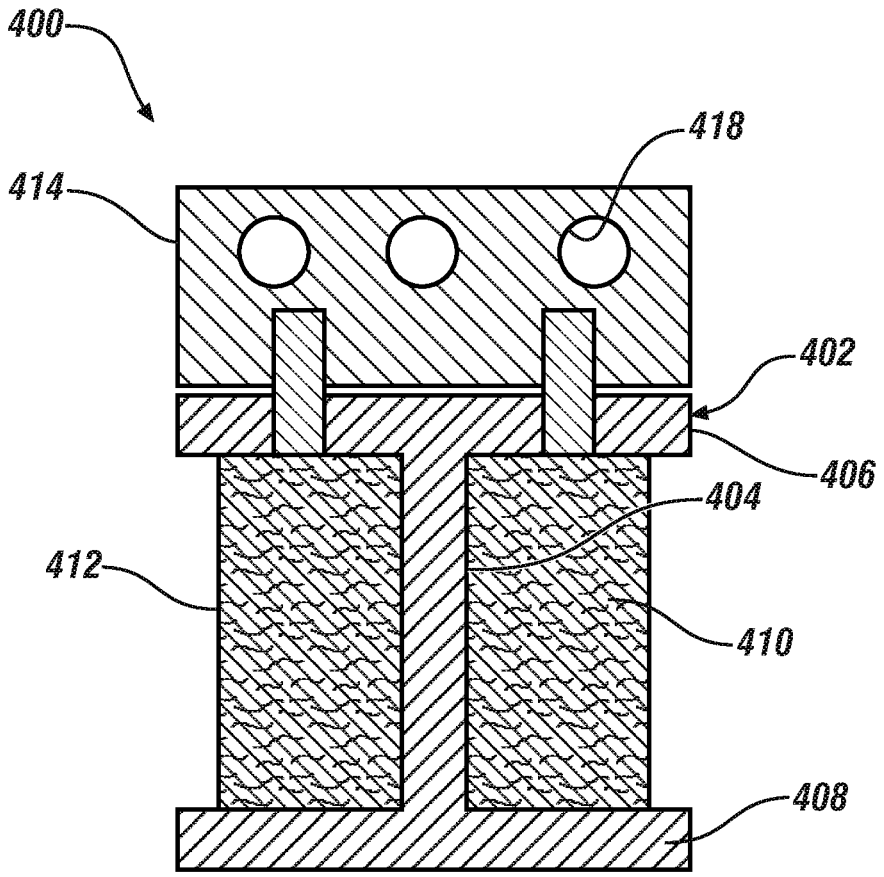
FIG. 4 is a schematic end view of a reinforced transfer beam in the form of a reinforced I-beam, in accordance with the disclosure.

FIG. 4 schematically shows an end view of a reinforced transfer beam 400 in the form of a reinforced I-beam 400, which may be employed as one of the reinforced transfer beams 90 that are described with reference to FIG. 2. In one embodiment, and as described herein, the reinforced transfer beam 400 includes a structural steel I-beam 402 and one or a plurality of carbon-fiber reinforcement elements 410, 412 arranged to reinforce the structural steel I-beam 402. Alternatively, the steel portion of the reinforced transfer beam 400 may be configured as C-beam, a T-beam, an L-beam, a square beam, a rectangular beam, etc. As shown, the reinforced I-beam 400 includes the structural steel I-beam 402, which includes a web portion 404 interposed between top and bottom flanges 406, 408, respectively, and one or a plurality of carbon-fiber reinforcement elements 410, 412 arranged to reinforce the structural steel I-beam 402.

The carbon-fiber reinforcement elements 410, 412 are disposed on opposite sides of the web portion 404 between the top and bottom flanges 406, 408. The carbon-fiber reinforcement elements 410, 412 may be molded in place on the I-beam 402 in one embodiment. Alternatively, the carbon-fiber reinforcement elements 410, 412 may be pre-molded and assembled on the I-beam 402 employing retaining clips, fasteners, etc. In one embodiment, a flange 414, or alternatively, a span plate (not shown) may be attached to the end of the I-beam 402 via bolts, fasteners, welding, etc. The flange 414 may have one or a plurality of pre-drilled through-holes 418 disposed therein. Alternatively or in addition, one or a plurality of through-holes may be drilled at preset locations in the top and bottom flanges 406, 408 and/or the web portion 404 of the structural steel I-beam 402. The flange 414 and associated through-holes 418 facilitate attachment of the reinforced I-beam 400 to another element, without a need to drill into the carbon-fiber reinforcement elements 410, 412 and without a need to weld onto the I-beam 402 proximal to the carbon-fiber reinforcement elements 410, 412. The flange 414 may be assembled onto the I-beam 402 prior to addition of the carbon-fiber reinforcement elements 410, 412, or alternatively, at another suitable time during building fabrication.

The use of the reinforced transfer beam 400 results in increased beam strength allowing for a reduction in beam depth and consequent reduction in floor-to-floor height, an increased clearance height on each floor, and increased stiffness of cantilevered floor plates resulting in reduced deflection at floor plate perimeter and corners, when compared to a non-reinforced steel beam. The reinforced transfer beam may be employed to provide localized strength enhancement for increased strength to carry special equipment loads or other loads on one or more of the floor levels, or portions thereof, without increasing beam depth as compared to a non-reinforced steel beam, or without affecting useable clear height on one or more of the floors, or portions thereof. The reinforced transfer beam 400 may have a reduced depth as compared to a non-reinforced steel beam, which may provide a corresponding reduction in floor-to-floor height as compared to a building that is fabricated with non-reinforced structural beams, e.g., steel-only I-beams. A reduction in the floor-to-floor height may provide addition of floor levels where overall building height is code-limited, increase a useable clear height on each of the floor, and increase stiffness of cantilevered floor plates, which results in reduced deflection at floor plate periphery and at corners.

Figure 3:
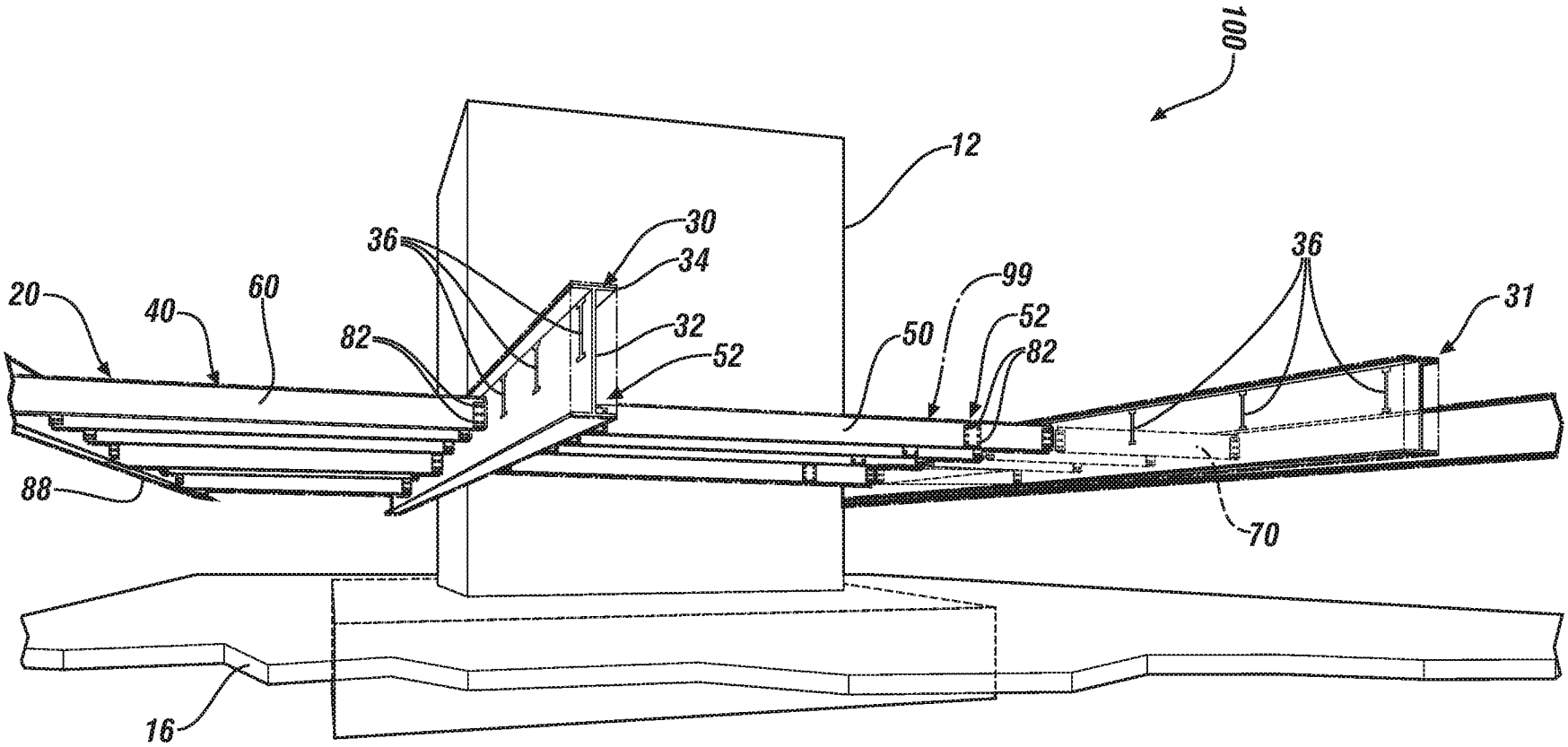
FIG. 3 is a schematic perspective view of elements of a floor plate and a vertical support core of a partially constructed building, in accordance with the disclosure.

FIG. 3 schematically shows elements of one of the floor plates 20, which is assembled as a woven structure in the form of main framing members e.g., first and second girders 30, 31, a plurality of transversely-oriented continuous framing members 40, and in one embodiment, spandrels 88. The first and second girders 30, 31 run continuously between supports that may be attached to the lifting devices 15. The continuous framing members 40 penetrate the first and second girders 30, 31 and are supported at multiple points with preset cambers. Camber is defined as a deviation from a flat, level, horizontal plane. Each of the continuous framing members 40 is an assembled part that includes a medial beam 50 and first and second cantilevered beams 60, 70.

Any one of and all of the first and second girders 30, 31, the medial beam 50 and first and second cantilevered beams 60, 70 may be embodied as a reinforced transfer beam, as illustrated with reference to element 99 and as described with reference the reinforced transfer beam 400 of FIG. 4. The use of the reinforced transfer beam 400 may result in a floor assembly that may be exploited to reduce beam depth without increasing vertical deflection, as compared to a non-reinforced steel beam. The woven structure-framed roof and floor plates impart precise amounts of camber at the connection points. The connections may be friction-bolted at inflection points to meet camber requirements. The combination of bolted, four-sided connectors together with the woven structure creates an efficient and flexible roof and floor plate structure that may be adjusted for camber control during assembly. The woven structure maximizes the strength of the transverse beams, permitting beam depth to be reduced as compared to a non-reinforced steel beam. Weight and overall depth of the floor plates 20 is thereby minimized. Furthermore, openings in the main longitudinal girders, e.g., first and second girders 30, 31, to permit the penetration of the first and second cantilevered beams 60, 70 may be cut to close tolerances, providing bracing at locations of penetrations. This bracing further acts to prevent unintended rotation of the transverse members during assembly even before any connections have been installed, providing a safety benefit.

In one embodiment, the floor plate 20 includes the first and second girders 30, 31 that are arranged in parallel and slidably disposed on opposed sides of the vertical support core 12 in a manner that permits and facilitates vertical conveyance. Each of the first and second girders 30, 31 includes a vertically-oriented web portion 32 and a flange portion 34. The first and second girders 30, 31 may each be configured, by way of non-limiting examples as an I-beam, a C-beam, a T-beam, an L-beam, a square beam, a rectangular beam, etc., and may advantageously include carbon-fiber reinforcement elements (not shown). A plurality of apertures 36 are formed in the vertically-oriented web portions 32, and are configured to accommodate insertion of one of the first and second cantilevered beams 60, 70 that include the carbon-fiber reinforcement elements (not shown).

A plurality of the continuous framing members 40 are disposed transverse to the first and second girders 30, 31. Each of the framing members 40 includes the medial beam 50 that is attached to the first and second cantilevered beams 60, 70, and is arranged transverse to and supported by the first and second girders 30, 31.

The medial beam 50 and the first and second cantilevered beams 60, 70 are each configured to have a flat beam section on a top portion of the respective beam along its longitudinal axis. The medial beam 50 may be configured as an I-beam, a C-beam, a T-beam, an L-beam, a square beam, a rectangular beam, etc., which defines a respective cross-sectional shape, and may advantageously employ carbon-fiber reinforcement elements (not shown). The medial beam 50 includes first and second ends 52, 54, respectively, with a plurality of bolt through-holes disposed thereat.

The first and second cantilevered beams 60, 70 may be configured as an I-beam, a C-beam, a T-beam, an L-beam, a square beam, a rectangular beam, etc., which defines a respective cross-sectional shape, and may advantageously include carbon-fiber reinforcement elements (not shown). The cross-sectional shape associated with the first cantilevered beam 60 corresponds to the respective aperture 36 in the first girder 30, and the cross-sectional shape associated with the second cantilevered beam 70 corresponds to the respective aperture 36 in the second girder 31. Each of the first cantilevered beams 60 includes first and second ends, with a plurality of bolt through-holes disposed thereat. Each of the second cantilevered beams 70 includes first and second ends, with a plurality of bolt through-holes disposed thereat. The medial beams 50 are horizontally disposed between the first and second girders 30, 31. The length of each medial beam 50 is selected to define inflection points at the connections to the first and second cantilevered beams 60, 70.

The first end of each of the first cantilevered beams 60 is threaded through one of the apertures 36 of the first girder 30 and is attached to the first end 52 of the respective medial beam 50 and defines a first inflection point that has a first camber. The first end of each of the first cantilevered beams 60 is attached to the first end of the respective medial beam 50 employing span plates and friction bolts 82 via bolt through-holes. The first cantilevered beam 60 is also attached to the first girder 30 mid-span employing angle plates and friction bolts via other bolt through-holes. The second ends of the first cantilevered beams 60 are attached to one of the spandrels 88.

The first end of each of the second cantilevered beams 70 is threaded through one of the apertures 36 of the second girder 31 and is attached to the second end 54 of the respective medial beam 50 and defines a second inflection point that has a second camber. The first end of the second cantilevered beam 70 is attached to the second end 54 of the respective medial beam 50 employing span plates 80 and friction bolts 82 via bolt through-holes. The second cantilevered beam 70 is also attached to the first girder 30 mid-span employing angle plates 84 and friction bolts 82 via other bolt through-holes. The second ends of the second cantilevered beams 70 are attached to another spandrel 88. The first and second cambers are selected such that an upper planar surface of the floor plate 20 forms a flat horizontal surface when the floor plate 20 is fixedly attached to the vertical support core 12. Each of the previously constructed, lifted and permanently supported floor plates 20 is analyzed for deflection prior to fabrication of a subsequent one of the floor plates 20, as part of the design process. Anticipated deflection values for each of the completed floor plates 20 in its permanently supported configuration are determined for key points on the structural frame. This permits each of the floor plates 20 to achieve a flat, level geometry in its final connected setting.

Prior to tightening the friction bolts 82 at the first and second junctions the frame geometry may be adjusted to achieve the designed deflection values at key points. Once the desired camber values have been achieved, the friction bolts 82 can be tightened to secure the first and second junctions. The floor plate 20 may be lifted at its permanent support points via lifting devices 15 and hardenable material may be deposited thereon to form the floor plate 20 prior to being lifted into place. As each floor plate 20 is installed in its final connected condition, field measurements of flatness may be taken. Additional adjustments to camber may be made through the adjustment of the imparted camber connections to improve flatness tolerances of each successively installed floor plate.

The building 100 employs cantilevered floor plates for roof and floor plate framing in one embodiment. The roof and floor plate assemblies have progressing conditions of loading and deflection throughout fabrication, lifting to final elevation, permanent connection to the vertical conveyance structure, application of service loads, and similar conditions encountered during construction and use. Consequently, the structural engineering process incorporates these multiple and varying conditions into the design of the structural system, along with consideration of appropriate tolerances for other elements, including but not limited to building envelope, interior partitions, mechanical and electrical systems, and live loads.

The detailed description and the drawings or figures are supportive and descriptive of the disclosure, but the scope of the disclosure is defined solely by the claims. While some of the best modes and other embodiments for carrying out the claimed teachings have been described in detail, various alternative designs and embodiments exist for practicing the disclosure defined in the appended claims.

The invention claimed is:

1. A building, comprising:

a lower structural pad disposed on a foundation;

a plurality of columns disposed on the lower structural pad, including a first of the columns that is separated from a second of the columns by a first span;

a plurality of horizontally-oriented reinforced transfer beams, wherein each of the reinforced transfer beams spans between the first of the columns and the second of the columns;

a vertical support core including a first vertically-oriented structural spine and a second vertically-oriented structural spine;

wherein the first and second vertically-oriented structural spines are disposed on the reinforced transfer beams with an interposed assembly pad, and separated by a second span;

wherein the second span associated with the first and second vertically-oriented structural spine is less than the first span associated with the first and second of the columns;

wherein each of the reinforced transfer beams comprises a steel beam and a carbon-fiber reinforcement element.

2. The building of claim 1, wherein the carbon-fiber reinforcement element spans a portion of the steel beam that is defined by the first span between the first and the second of the columns.

3. The building of claim 1, wherein each of the steel beams of the reinforced transfer beams comprises one of an I-beam, a C-beam, a T-beam, an L-beam, a square beam, and a rectangular beam.

4. The building of claim 1, wherein each of the reinforced transfer beams includes a flange portion disposed on at least one end thereof.

5. The building of claim 1, wherein each of the reinforced transfer beams includes a plurality of pre-drilled holes.

6. The building of claim 1, further comprising a floor plate suspended from the vertical support core;

wherein the floor plate includes a floor plate frame including first and second girders and a plurality of framing members;

wherein each of the framing members comprises a reinforced beam including a steel beam and a carbon-fiber reinforcement element.

7. The building of claim 6, wherein each of the framing members includes a medial beam that is attached to first and second cantilevered beams, and wherein each of the first and second cantilevered beams comprises a reinforced beam including a steel beam and a carbon-fiber reinforcement element.

8. The building of claim 7, wherein each of the steel beams of the reinforced beams of the first and second cantilevered beams comprises one of an I-beam, a C-beam, a T-beam, an L-beam, a square beam, and a rectangular beam.

9. The building of claim 6, wherein each of the first and second girders comprises a reinforced beam including a steel beam and a carbon-fiber reinforcement element.

10. The building of claim 9, wherein each of the steel beams of the reinforced beams of the first and second girders comprises one of an I-beam, a C-beam, a T-beam, an L-beam, a square beam, or a rectangular beam.

11. A building, comprising:

a plurality of columns disposed on a foundation;

a plurality of horizontally-oriented reinforced transfer beams, wherein each of the reinforced transfer beams spans between a first of the columns and a second of the columns, and wherein each of the reinforced transfer beams comprises a steel beam and a carbon-fiber reinforcement element; and a vertical support core including a first vertically-oriented structural spine and a second vertically-oriented structural spine;

wherein the first and second vertically-oriented structural spines are disposed on the reinforced transfer beams with an interposed assembly pad.

12. The building of claim 11, wherein the carbon-fiber reinforcement element spans a portion of the steel beam that is defined by a span between the first and the second of the columns.

13. The building of claim 11, wherein each of the steel beams of the reinforced transfer beams comprises one of an I-beam, a C-beam, a T-beam, an L-beam, a square beam, and a rectangular beam.

14. The building of claim 11, wherein each of the reinforced transfer beams includes a flange portion disposed on at least one end thereof.

15. The building of claim 11, wherein each of the reinforced transfer beams includes a plurality of pre-drilled holes.

16. The building of claim 11, further comprising a floor plate suspended from the vertical support core;

wherein the floor plate includes a floor plate frame including first and second girders and a plurality of framing members; and wherein each of the framing members comprises a reinforced beam including a steel beam and a carbon-fiber reinforcement element.

17. The building of claim 16, wherein each of the framing members includes a medial beam that is attached to first and second cantilevered beams, and wherein each of the first and second cantilevered beams comprises a reinforced beam including a steel beam and a carbon-fiber reinforcement element.

18. The building of claim 17, wherein each of the steel beams of the first and second cantilevered beams of the framing members comprises one of an I-beam, a C-beam, a T-beam, an L-beam, a square beam, and a rectangular beam.

19. The building of claim 16, wherein each of the first and second girders comprises a reinforced beam including a steel beam and a carbon-fiber reinforcement element.

20. The building of claim 19, wherein each of the steel beams of the first and second girders comprises one of an I-beim, a C-beam, a T-beam, an L-beam, a square beam, and a rectangular beam.

* * * * *